United States Patent [19]

Shiba et al.

[11] 3,930,860

[45] Jan. 6, 1976

[54] SPECTRALLY SENSITIZED COLOR PHOTOGRAPHIC MATERIALS SUITABLE FOR HIGH TEMPERATURE RAPID DEVELOPMENT

[75] Inventors: Keisuke Shiba; Masanao Hinata; Seiiti Kubodera, all of Minami-ashigara, Japan

[73] Assignee: Fuji Photo Film Co., Ltd., Minami-ashigara, Japan

[22] Filed: Jan. 2, 1974

[21] Appl. No.: 429,983

[30] Foreign Application Priority Data

Dec. 29, 1972 Japan ..... 48-2544

[52] U.S. Cl. ..... 96/56; 96/85; 96/137; 96/139

[51] Int. Cl.[2] ..... G03C 7/00

[58] Field of Search ..... 96/137, 139, 85, 56

[56] References Cited

UNITED STATES PATENTS

| | | | |
|---|---|---|---|
| 3,480,434 | 11/1969 | Hanna | 96/74 |
| 3,573,916 | 4/1971 | Yost et al. | 96/85 |
| 3,703,377 | 11/1972 | Sakazume et al. | 96/139 |
| 3,713,828 | 1/1973 | Hayashi et al. | 96/139 |
| 3,713,835 | 1/1973 | Sato et al. | 96/137 |
| 3,814,609 | 6/1974 | Shiba et al. | 96/137 |
| 3,822,136 | 7/1974 | Sakazume et al. | 96/137 |

*Primary Examiner*—J. Travis Brown

*Attorney, Agent, or Firm*—Sughrue, Rothwell, Mion, Zinn & Macpeak

[57] ABSTRACT

A light-sensitive silver halide material for the high temperature and rapid color development at least 30°C, which light-sensitive silver halide material comprises at least one spectrally sensitized silver halide photographic emulsion layer, the emulsion layer containing at least one sensitizing dye having an halogen ion concentration increasing effect.

10 Claims, 1 Drawing Figure

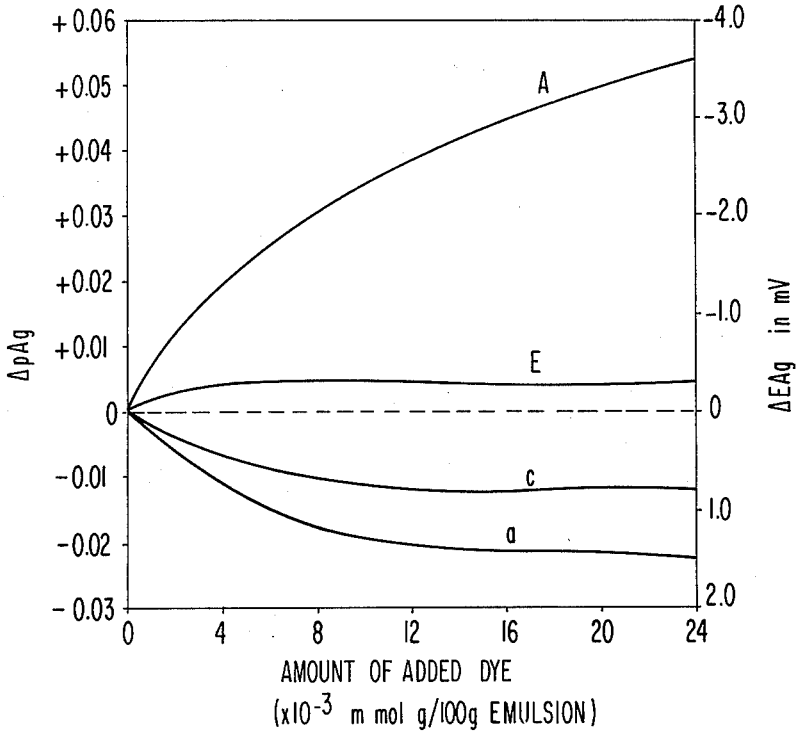
+0.06
+0.05
+0.04
+0.03
+0.02
+0.01
0
-0.01
-0.02
-0.03
ΔpAg
-4.0
-3.0
-2.0
-1.0
0
1.0
2.0
ΔEAg in mV
A
E
c
a
0
4
8
12
16
20
24
AMOUNT OF ADDED DYE
(x10-3 m mol g/100g EMULSION)

SPECTRALLY SENSITIZED COLOR PHOTOGRAPHIC MATERIALS SUITABLE FOR HIGH TEMPERATURE RAPID DEVELOPMENT

BACKGROUND OF THE INVENTION

1. Field of the Invention

This invention relates to a color light-sensitive material suitable for use in a high temperature rapid treatment and, more particularly, it is concerned with a color light-sensitive material having improved spectral sensitivity, grain property and fog and treated at a high temperature of at least about 30°C.

2. Description of the Prior Art

It has lately been desired to provide a light-sensitive material which can be developed rapidly. To this end, various approaches have been made. For example, a light-sensitive material is developed at a high temperature to achieve rapid development. However, if such a high temperature rapid development is carried out, conventional light-sensitive materials result in much fog from the sensitivity obtained and, consequently, in a positive light-sensitive material, the clarity of the high light portions dedeteriorates and the grain property tends to coarsen. In other words, therefore, with the high temperature rapid development treatment commonly employed, an excellent image quality is hard to obtain with retention of high sensitivity. Where a support member member used in a light-sensitive material has a hydrophobic surface the sensitive material tends to be developed more rapidly and more fog results than in the case of, for example, a baryta paper having a hydrophilic surface. Where the support member has a hydrophobic surface, however, particular techniques are made to coat it with a light-sensitive emulsion. For instance, treatment by irradiation with electron beams as a means for improving the adhesion between the support and light-sensitive emulsion is used. This treatment tends to induce more fog. When using a two equivalent coupler in place of a four equivalent coupler, the efficiency of color forming can be markedly increased but fog tends to occur. In this case, the use of a high temperature rapid treatment results in even more marked occurrence of fog. Many devices have been proposed therefor. In order to prevent fog from occurring during development (development fog), an antifoggant is added to a developer. The addition of this antifoggant, however, tends to reduce the sensitivity. For the production of light-sensitive materials, in general, spectral sensitization techniques are used. Generally a sensitizing dye is added to an original photo-sensitive emulsion, but the sensitizing dye, in general, tends to increase fog. Therefore, studies of sensitizing dyes which do not increase the occurrence of fog have been made. If a sensitizing dye contained in a light-sensitive material is subjected to a high temperature rapid development, which sensitizing dye is considered to be substantially free from increasing the occurrence of fog, in general, development fog is remarkably increased due to the use of such a sensitizing dye.

It is an object of the invention to overcome these disadvantages. It is another object of the invention to provide a color light-sensitive material capable of providing high sensitivity with less fog. It is a further object of the invention to provide a color light-sensitive material having an excellent image quality even when subjected to a high temperature rapid development. These and other objects will be apparent from the following detailed description of the invention.

SUMMARY OF THE INVENTION

These objects of the invention can be accomplished by a light-sensitive material for high temperature rapid color development, which light-sensitive material comprises at least one spectrally sensitized silver halide photographic emulsion layer, this emulsion layer containing at least one sensitizing dye having an "HICI effect" as defined hereinafter in this specification.

BRIEF DESCRIPTION OF THE ACCOMPANYING DRAWING

The FIGURE shows graphically the relationship between the change in pAg and in EAg and the amount of dye added to the emulsion for dyes within the scope of the invention and dyes for comparison.

DETAILED DESCRIPTION OF THE INVENTION

A feature of the invention lies in the action or effect of suppressing fog in high temperature color development at 25°C or higher, in particular, 30°C or higher rather than in the sensitization of a sensitizing dye used. As is well known in the art, in the production of light-sensitive materials, a number of different varieties of sensitizing dyes are used, for example, the sensitizing dyes using the synthetic method as disclosed in *The Cyanine Dyes and Related Compounds* by F. M. Hamer, published by Interscience Publishers Co., 1964, German Patent No. 704,141, U.S. Pat. No. 2,503,776 and German Pat. Nos. 929,080 and 1,072,765, the sensitizing dyes described in British Pat. No. 840,223 and the sensitizing dyes having heterocyclic rings with substituents such as those described in *Zeitshrift fur Wissenschaftliche Photographie* by E. J. Hoppe, Vol. 63, page 149–158 (1969) in nuclei of polymethine dyes such as cyanine dyes, merocyanine dyes, complex merocyanine dyes, neutro cyanine dyes, hemicyanine dyes and styryl dyes described in U.S. Pat. Nos. 2,739,149, 2,912,329, 2,778,823, 2,493,748 and 2,519,001 and F. M. Hamer, ibid. It is known that most of these sensitizing dyes do not have any affect on the occurrence of fog during development at ordinary temperatures, for example, 20°C or 24°C or do not tend to increase the fog when added to a silver halide original emulsion.

It was surprisingly found that of these known sensitizing dyes, a specific dye can suppress markedly fog during development at high temperatures of at least about 30°C, which cannot be suppressed by other dyes. In order to describe all of these sensitizing dyes capable of suppressing markedly the fog of development in a high temperature development, representation by a "general formula" of the chemical structure is impossible. Therefore, the sensitizing dyes having these desirable characteristics must be defined functionally by the halide ion concentration increasing effect which is given to an emulsion with the following composition. That is to say, the sensitizing dyes which are suitably used in the invention have the halide ion concentration increasing effect as defined hereinafter, which will be referred for brevity to as the "HICI effect". If the negative logarithm of the silver ion concentration, $\Delta pAg$, is plus in the test of HICI effect when the sensitizing dye is employed, the sensitizing dye is included as a dye within the scope of the present invention. Thus, the dyes of the invention can radily and correctly be distinguished from those which do not have the above described characteristic and are therefore outside the scope of the present invention.

The HICI effect is preferably confirmed by the use of a blank silver halide emulsion free from photographic addenda. However, it can readily and correctly be determined by the use of a silver halide blank emulsion obtained as follows.

A silver halide photographic emulsion which can be used for determining the HICI effect is prepared according to Wall's formulation described in *Photographic Chemistry* by P. Glafkides, Vol. 1 (English Translation: K. M. Horus), published by Fountain Press Co., (1958), page 344–345, sec.325, as described below

| Mixture A: | |
|---|---|
| Distilled Water | 500 ml |
| Ammonium Bromide | 20 g |
| Sodium Chloride | 10 g |
| Citric Acid | 50 g |
| Gelatin | 70 g |
| Mixture B: | |
| Distilled Water | 500 ml |
| Silver Nitrate | 50 g |
| Citric Acid | 50 g |

Mixture A is warmed at 70°C and Mixture B is added thereto with agitation over a period of 50 minutes. Then the mixture is subjected to physical ageing for 10 minutes, cooled, set and washed with water. This emulsion has a pH of 6.4 and pAg of 7.8.

The HICI effect of a sensitizing dye is determined as follows. The HICI effect corresponds to a change of approximately 0.010 based on the pAg scale. This determination is carried out using differential potentiometry, for example, according to the method as disclosed in *Journal of Colloid Science* by A. H. Herry and J. O. Helling, Vol. 17 (1962), page 293. That is to say, the determination is conducted under thermostatically controlled conditions at 40°C ± 0.1°C. Two vessels for silver halide emulsion, having the same form and capacity, are set, each being provided with a stirrer of the same shape and having the same revolution rate. The two vessels are contacted with a saturated calomel electrode (SCE) through a salt bridge of 1 N potassium nitrate. The two emulsion vessels are connected to a potentiometer respectively through silver electrodes, while the SCE is connected to the same potentiometer. The potentiometer is type E-436 manufactured by the Metrome Co. Using such an apparatus, the HICI effect of the specimen at 40°C can be determined. The sensitizing dye is used as a methanol solution. The change of potential produced by the addition of the methanol can be compensated for by adding equal amounts of methanol to both emulsion vessels. The procedure of this kind is commonly used in not only the field of photography but also in analytical chemistry fields.

For the purpose of suppressing fog, a compound that is usually known as an antifoggant is added to an original emulsion or developer, for example, as described in *Photographic Chemistry* by P. Glafkides, Vol. 1, page 374 sec. 349, page 378 sec. 350, page 379 sec. 351, page 380 sec. 352. However, such a compound has unfavourable side effects in that the sensitivity is lowered and the developing speed is retarded, and, in addition, has less spectral sensitization unlike the dye used in the invention.

Since more fog occurs in the case of a photo-sensitive material using a hydrophobic support such as synthetic paper or resin-coated paper (as disclosed in U.S. Pat. Nos. 3,582,333 and 3,573,916 regarding "hydrophobic" character) than in the case of a photo-sensitive material using a paper such as a baryta paper as a support, the sensitizing dye used in the invention is markedly effective for suppressing the occurrence of fog. When a support laminated with a polyolefin thus providing a hydrophobic surface is subjected to a treatment with electron beams and coated with a silver halide emulsion, fog occurs. It is known, for example, from the disclosure of U.S. Pat. No. 3,582,333 that this occurrence of fog can be inhibited by the addition of a reducing agent. The dye according to the invention can strongly prevent the occurrence of fog while effecting sensitization in a more effective manner than those disclosed in the above described specification.

When used jointly in a coupler-in-the emulsion type silver halide emulsion system, more fog occurs in practice where a coupler of the two equivalent type is used than where a coupler of four equivalent type is used, so the sensitizing dye according to the invention provides an even more marked fog inhibiting effect to the development of the latter.

A further feature of the present invention is that the fog inhibiting property of the dye of the present invention is remarkable, in particular, for color development using p-phenylenediamine derivatives as color forming developing agents. However, this marked fog inhibiting property was not particularly observed for black-and-white development using hydroquinone and its derivatives, pyrazolidone derivatives, p-aminophenol derivatives, ascorbic acid and its derivatives as developing agents. This was a surprising fact which could not easily be expected from the well-known mechanism of action of an antifoggant.

The present invention includes color light-sensitive materials that are subjected to a high temperature rapid treatment with a developer containing a coupler.

Preferred examples of the sensitizing dyes of the invention having an HICI effect are sensitizing dyes represented by the following general formula (I)

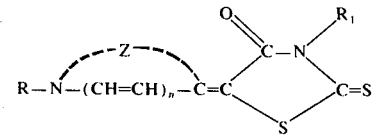

(I)

in which R represents a sulfoalkyl group (such as a sulfoethyl group, a sulfopropyl group, or a sulfobutyl group, preferably having 1 to 4 carbon atoms in the alkyl moiety), Z represents an atomic group necessary for forming a benzoxazole nucleus, a benzthiazole nucleus, a benzimidazole nucleus, or a pyridine nucleus wherein the carbon atoms of these nuclei may be substituted by a substituent which does not deteriorate the photographic properties, such as a halogen atom (e.g. chlorine, etc.), a lower alkyl group (e.g. methyl, ethyl, etc.), a lower alkoxy group (e.g. methoxy, ethoxy, etc.), a trifluoromethyl group and a cyano group, *n* represents 0 or 1, $R_1$ represents a lower alkyl group having up to 6 carbon atoms, a carboxy alkyl group (such as a carboxymethyl group, a carboxyethyl group, etc.), an aralkyl group (such as a benzyl group, a phenethyl group, a p-carboxybenzyl group and a sulfobenzyl group) or a saturated or unsaturated cyclic hydrocarbon group (such as a cyclohexyl group, an aryl group such as a phenyl group and a substituted phenyl group, substituted by, for example, halogen (e.g. chlorine), a carboxy group or a sulfo group) or the sensitizing dye represented by the following general formula (II)

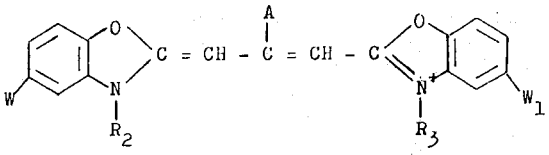

(II)

in which A represents a lower alkyl group (having up to 3 carbon atoms, such as a methyl group or an ethyl group), $R_2$ and $R_3$ each represents an alkyl group (preferably having up to 8 carbon atoms, such as a methyl group, an ethyl group, and a propyl group), a sulfo alkyl group (preferably having up to 4 carbon atoms such as a sulfoethyl group, a sulfopropyl group and a sulfobutyl group) or a sulfoalkoxyalkyl group (such as a sulfoethoxyethyl group, or a sulfopropoxyethoxyethyl group), with at least one of $R_2$ or $R_3$ being a sulfoalkyl group or a sulfoalkoxyalkyl group, W represents a halogen atom or a phenyl group and $W_1$ represents a halogen atom.

Specific examples of suitable dyes of the invention are given in the following without limiting the same:

(1)

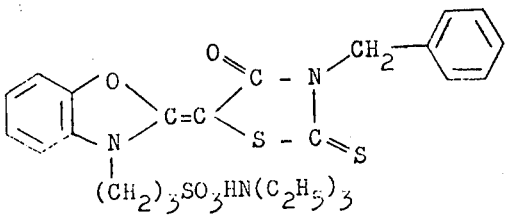

(2)

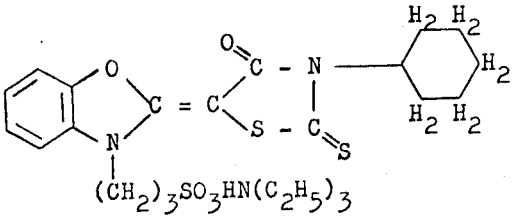

(3)

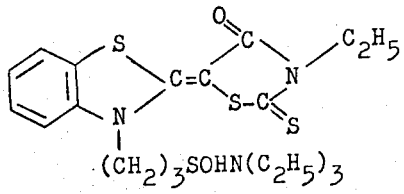

(4)

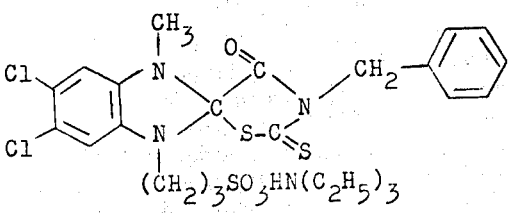

(5)

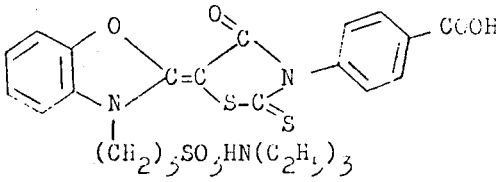

(6)

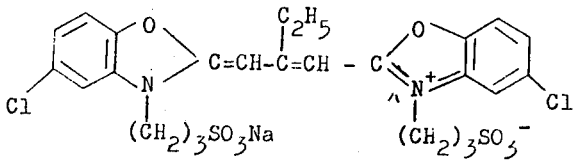

(7)

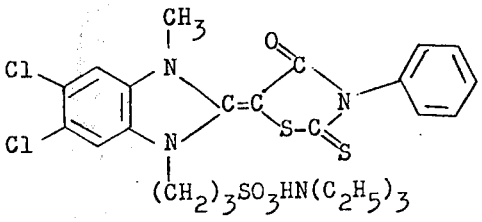

Comparative Dyes (a)

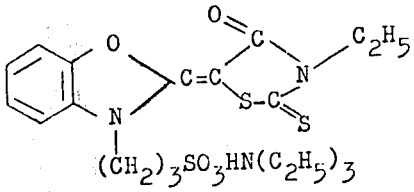

(b)

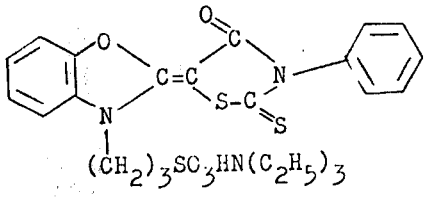

(c)

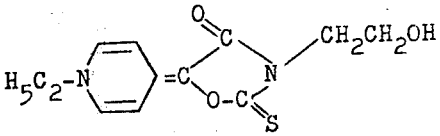

(d)

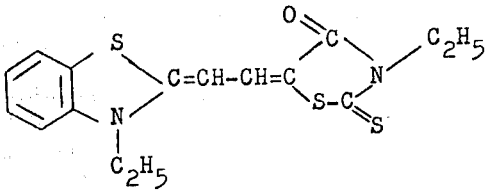

(e)

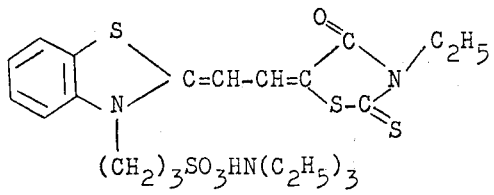

(f)

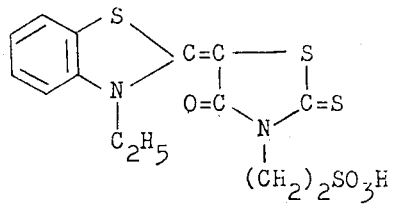

(g)

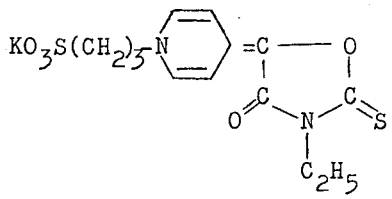

(h)

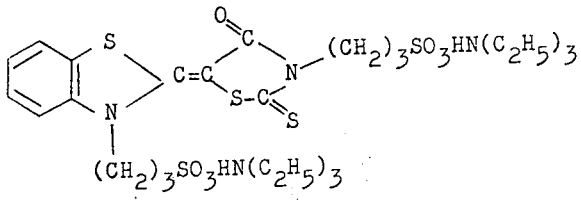

Experiment examples demonstrating more specifically the determination of the HICI effect are as follows:

EXPERIMENT EXAMPLES 100 g of the foregoing original emulsion prepared using Wall's formulation is correctly weighed and charged respectively in two emulsion vessels, melted at 40°C, stirred and stored. A specific sensitizing dye as shown in Table 1 is added to one emulsion as a methanol solution in a concentration of $1 \times 10^{-3}$ mol or $5 \times 10^{-4}$ mol, stirred and allowed to stand for a period of time sufficient for the dye to be adsorbed by the silver halide emulsion (about 10 minutes), while the same quantity of methanol is added to the other emulsion. A minute potential difference (ΔEAg) caused by the adsorption of the dye is measured and the HICI effect is thus determined with comparison of the previously obtained EAg and pAg change. The dyes of the invention show an HICI effect, while most of the dyes other than the dyes of the invention show rather a reduction in the halide ion concentration. A change of a ΔEAg of about 0.40 millivolt corresponds to a change of about 0.060 in pAg units and a reduction of the ΔEAg (in the minus direction) corresponds to an increase of the pAg, i.e. the HICI effect.

The results obtained are shown in Table 1 and the Figure. The HICI effect depends upon the quantity of the dye added, but, ordinarily, the directions of increase or reduction are the same. That is to say, the HICI effect is not reversed by the quantity added. $1 \times 10^{-6}$ mol g to $5 \times 10^{-5}$ mol g is ordinarily used per 100 g of the emulsion and it is desirable to determine the HICI effect using the dye in an amount ranging from ½ to 10 times as much as the quantity of the dye commonly used (see FIG. 1).

Table 1

| No. | Dye Employed | Change of pAg $8 \times 10^{-3}$ millimol g | Value $2.4 \times 10^{-2}$ millimol g | HICI Effect |
|---|---|---|---|---|
| a | (1) | +0.030 | +0.053 | plus + |
| 2 | (2) | +0.038 | +0.055 | + |
| 3 | (3) | +0.010 | +0.018 | + |
| 4 | (4) | +0.009 | +0.020 | + |
| 5 | (5) | +0.005 | +0.005 | + |
| 6 | (6) | +0.001 | +0.002 | + |
| 7 | (a) | −0.018 | −0.022 | minus − |
| 8 | (b) | −0.021 | −0.029 | − |
| 9 | (c) | −0.010 | −0.012 | − |
| 10 | (d) | −0.012 | −0.030 | − |
| 11 | (e) | −0.027 | −0.033 | − |

It can be understood from the results set forth in Table 1 that even a slight difference in chemical structure between dyes results in a marked difference specifically in the HICI effect. In view of the HICI effect and the photographic properties discribed in the Examples, in particular, the inhibition of development fog, it can be understood that an interrelation exists between the HICI effect and inhibition of development fog.

The silver halide photographic emulsions which can be used in the invention are emulsions containing silver chloride, silver chlorobromide, silver chloroiodobromide, silver chloroiodide, silver bromide, silver iodobromide and mixtures, thereof. The emulsions preferably are a silver chloroiodobromide emulsion containing 2 mol % or less of silver iodide and a silver iodobromide emulsion containing 7 mol % or less of silver iodide. The average diameter by number (measured by the projected area method) of silver halide grains is preferably from 0.04 micron to 2 microns, in particular, 0.2 micron to 0.7 micron. The crystal habit can be either of (100) surface grains or (111) surface grains, but the HICI effect is remarkable for (100) surface grains. The emulsion of the invention is preferably subjected to a suitable chemical sensitization to improve the progress of development as well as to increase the sensitivity. ("Ia: Properties of Photographic Emulsion Grains" *J. Phot. Sci.*, 12 (1964) pp. 242–251; "The Spectral Sensitization of Silver Bromide Emulsion on Different Crystallographic Faces" *J. Phot. Sci.*, 13 (1965) pp. 85–89) As such chemical sensitization are employed a metal salt sensitization, gold sensitization and sulfur sensitization as described in *Chimie et Physique Photographiques* by Pierre Glafkides, 3rd Edition, Publications Photo-Cinema Paul Montel (1967), page 350, for example, using potassium chloroaurate, sodium aurodithiocyanate, sodium aurothiosulfate, ammonium chloroaurate, ammonium chloropalladate ($(NH_4)_2PdCl_6$) and gold selenide. In addition, sulfur sensitization is carried out, for example, using allyl isocyanate, cystine, sodium thiocyanate, cadmium thiocyanate or thiourea, and further reduction sensitization is carried out, for example, using stannous chloride, hydrazine sulfate or its derivatives or polyethyleneimino compounds, as described in U.S. Pat. Nos. 2,448,060, 2,399,083, 2,540,085, 2,540,086, 2,597,856 and 2,642,361.

As the occasion demands, the dye of the invention can be jointly used with other polymethine dyes, for example, cyanine dyes such as the pseudocyanines, benzoimidazolocarbocyanines, imidaoxacarbocyanines, thiacarbocyanines, selenacarbocyanines and naphthothiacarbocyanines, the merocyanine dyes such as the benzooxathiohydantoindimethinemerocyanines, thiazolinorhodaninedimethinemerocyanines and tetrazolorhodaninedimethinemerocyanines, complex merocyanine dyes and styryl dyes.

In the silver halide emulsion of the invention, optionally an antifoggant and stabilizer can be present with the sensitizing dye according to the invention. For example, the azaindenes, mercaptotetrazoles, metal salts of palladium and platinum, oximes, imidazolium salts and tetrazolium salts as disclosed in U.S. Pat. Nos. 2,444,605, 2,886,437, 2,403,927, 3,266,897, 3,399,987, 2,597,915 and 3,566,263, British Pat. No. 623,448, and U.S. Pat. Nos. 2,694,716, 2,131,038, 2,518,698, 3,369,904, 2,419,974 and 2,419,975 can be used. Moreover, nonionic and anionic surfactants as described in U.S. Pat. Nos. 2,423,549 and 2,441,389, and onium compounds as described in U.S. Pat. Nos. 2,271,623 and 3,148,067 can be added thereto. In addition, hardeners such as formaldehyde, mucochloric acid, glutaraldehyde, aziridines, dioxane derivatives, vinyl sulfones, oxypolysaccharides and chromium salts, coating aids such as saponin, alkysulfonates, alkylbenzenesulfonates and taurine derivatives, hydrophilic synthetic polymers, latex polymers, and irradiation inhibiting dyes can be incorporated in the emulsion.

The sensitizing dye of the invention can be used in a conventional sensitizing amount, preferably in a proportion of about $10^{-6}$ to $10^{-3}$ mol per 1 mol of silver halide. The method of addition thereof can for example be carried out according to German Laid Open Specification No. 2,104,283. The dyes of the invention can be also incorporated into a silver halide photographic emulsion in the same manner as conventional dyes, i.e. by dissolving the dye in a solvent such as water and a water-miscible organic solvent (e.g. methanol, acetone, methylcellosolve, pyridine, etc.).

The couplers-in-the-emulsion which can be used are the yellow couplers of the four equivalent diketomethylene type and yellow couplers of the two equivalent diketomethylene type as described in U.S. Pat. Nos. 3,415,652, 3,447,928, 3,311,476 and 3,408,194, the magenta couplers of the four equivalent or the two equivalent pyrazolone type as described in U.S. Pat. Nos. 3,419,391 and 3,214,437, and the magenta couplers of the indazolone type, the cyan couplers of α-naphthol type and the cyan couplers of the phenol type as described in U.S. Pat. Nos. 3,311,476, 3,458,315, 3,214,437 and 3,253,924. Dispersion of these couplers into emulsion can be carried out in conventional manner.

With these couplers, compounds capable of promoting color development can jointly be used as disclosed in U.S. Pat. Nos. 2,648,604, 3,671,247, 2,533,990, 2,577,127, 2,950,970, 3,068,097 and 3,201,242, such as 3-pyrazolidone derivatives, bissulfonylalkanes, phenol derivatives, aminophenol derivatives, polyalkyleneoxides, onium compounds and alkali precursors.

The exposure time for the light-sensitive material of the invention depends on the kind of and use for the sensitive material. For example, it is about 1/100 – 20 seconds for color papers and about 1/1000000 – 1 second for high sensitivity photographic materials.

The following examples are given to illustrate the present invention in greater detail without limiting the same. Unless otherwise indicated, all parts, percents, ratios and the like are by weight.

EXAMPLE 1

A predetermined amount of the dye as shown in Table 2 was added to a silver chlorobromide emulsion (170 g of gelatin per 1 mol of silver, 0.43 mol of silver per 1 kg of emulsion, Br: 90 mol %; Cl: 10 mol %) containing α-fluoro-α-pivaloyl-[5-(γ-2,4-di-t-amylphenoxy)butylamide]-2-chloroacetanilide as a coupler for a yellow image, and the resulting emulsion was coated onto a photographic paper having thereon a polyethylene coating, followed by drying. Each coated specimen was subjected to an optical wedge exposure for 1 second using a tungsten lamp (color temperature of light source: 2854°K) and treated with the following treating solutions and varying the temperature and time (Table 2):

| | |
|---|---|
| **Color Development Solution** | |
| Benzyl Alcohol | 12 ml |
| Diethylene Glycol | 3.5 g |
| Sodium Hydroxide | 2.0 g |
| Sodium Sulfite | 2.0 g |
| Potassium Bromide | 0.4 g |
| Sodium Chloride | 1.0 g |
| Borax | 4.0 g |
| Hydroxylamine Sulfate | 2.0 g |
| Ethylenediaminetetraacetic Acid | 2.0 g |
| 4-Amino-3-methyl-N-ethyl-N-(β-sulfonamidoethyl)aniline Sesquisulfate | 5.0 g |
| Water to | 1000 ml |
| **Stopping Solution** | |
| Sodium Thiosulfate | 10 g |
| Ammonium Thiosulfate (70%) | 30 ml |
| Sodium Acetate | 5 g |
| Acetic Acid | 30 ml |
| Potassium Alum | 15 g |
| Water to | 1000 ml |
| **Bleaching Solution** | |
| Ferric Sodium Ethylenediaminetetraacetate Dihydrate | 50 g |
| Potassium Bromide | 50 g |
| Ammonium Nitrate | 50 g |
| Ammonia (aqueous) | to adjust pH to 6.8 |
| Water to | 1000 ml |
| **Fixing Solution** | |
| Sodium Thiosulfate | 150 g |
| Sodium Sulfite | 15 g |
| Borax | 12 g |
| Glacial Acetic Acid | 15 ml |
| Potassium Alum | 20 g |
| Water to | 1000 ml |
| **Stabilizer** | |
| Boric Acid | 5 g |
| Sodium Citrate | 5 g |
| Sodium Metaborate Tetrahydrate | 3 g |
| Potassium Alum | 15 g |
| Water to | 1000 ml |

Processings

| | | |
|---|---|---|
| Color Development (Temperature and time were varied.) | | |
| Stopping | 30°C | 2 minutes |
| Water Washing | " | 2 minutes |
| Bleaching | " | 2 minutes |
| Water Washing | " | 2 minutes |
| Fixing | " | 2 minutes |
| Water Washing | " | 2 minutes |
| Stabilizing Bath | " | 2 minutes |
| Drying | " | 2 minutes |

Table 2

| Dye (millimol) gram/silver mol) | Blue Sensitivity* (relative value) | Color Development Fog | | |
|---|---|---|---|---|
| | | Development for 15 min at 24°C | Development for 7 min at 30°C | Development for 4 min at 38°C |
| Dye 1 (0.046) | 124 | 0.34 | 0.32 | 0.35 |
| Comparative Dye f (0.046) | 113 | 0.35 | 0.43 | 0.55 |
| Comparative Dye g (0.046) | 91.3 | 0.34 | 0.42 | 0.63 |
| No Dye | 100 | 0.34 | 0.39 | 0.40 |

*Exposure was carried out through a Fuji Filter SP 1 (produced by the Fuji Photo Film Co., Ltd.) as a blue filter. Standard sensitivity of dye free emulsion, set at 100

It is apparent from the results contained in the above table that there was no substantial difference of fog between the dye of the invention and comparative dye in the color development at 24°C, which the fog was similar to that in the case of no dye. In the developments at 30°C and 38°C, however, more fog appeared in the case of the emulsion containing the comparative dye than in the case of no dye, while the fog decreased in the case of the emulsion containing the dye according to the invention.

The sensitivity of the each dye does not vary relatively with the development treatments and Table 2 shows the relative values at 30°C. The sensitivity at a color development temperature of 24°C or 38°C was substantially the same as that at 30°C. It can thus be understood that the emulsion containing the dye of the invention has a higher sensitivity than that containing the comparative dye.

EXAMPLE 2

A predetermined amount of the dye as shown in Table 3 was added to a silver chlorobromide photographic emulsion (similar to Example 1) containing α-(4-palmitamidophenoxy)-α-pivaloyl-4-sulfoamylacetanilide as a yellow coupler described in U.S. Pat. No. 3,408,194 and further 2-n-octadecyl-5-(2-sulfo-tert-butyl)hydroquinone potassium salt as a commonly used antistain agent was incorporated therein. The resulting emulsion was applied to a photographic paper having thereon a polyethylene film coating.

To the blue sensitive emulsion layer was then applied a gelatin intermediate layer containing dioctylhydroquinone (5 g per 1 kg of 5% gelatin solution), to which a conventional green sensitive silver chlorobromide emulsion containing 1-phenyl-3-methyl-4-(4-methylsulfonylphenoxy)-5-pyrazolone (50 g per 1 kg of emulsion) as a coupler for a magenta image as described in British Pat. No. 1,140,898 was then applied. The coupler was dispersed in a conventional solvent such as tricresyl phosphate. The green sensitive emulsion layer contained dioctylhydroquinone (5 g per 1 kg of emulsion) as an antistain agent. Moreover, the green sensitive emulsion layer contained also bis-(1-p-sulfophenyl-3-carboxypyrazolo-5-one)trimethine (0.5 g per kg of emulsion) as a green light absorbing dyestuff for irradiation protection. Onto the green sensitive emulsion layer was coated a gelatin layer containing dioctylhydroquinone (5 g per 1 kg of 5% gelatin solution) dispersed in a solvent of tricresyl phosphate. Onto the gelatin layer was then coated a conventionally used red sensitive silver chlorobromide emulsion. The red sensitive emulsion contained 1-hydroxy-4-maleimido-2-naphthamide (70 g per 1 kg of emulsion) as a coupler for the cyan image as described in British Pat. No. 1,165,563, the coupler being dispersed in a solvent of dibutyl phthalate. The red sensitive emulsion contained dioctylhydroquinone (2 g per 1 kg of emulsion) as an antistain agent as well as bis-(1-p-sulfophenyl-5-ethoxycarbonylpyrazolo-5-one)pentamethine (1 g per 1 kg of emulsion) as a red light absorbing dyestuff.

The thus obtained multi-layer light-sensitive material was treated with the same treatment solutions as used in Example 1. The color development was carried out at 30°C for 7 minutes.

Table 3

| | Amount Added to Emulsion (milligram mol/silver mol) | Fog in development at 30°C for 7 min |
|---|---|---|
| Dye 1 | 0.092 | 0.65 |
| Dye 2 | 0.092 | 0.54 |
| Comparative Dye a | 0.092 | 1.40 |
| No Dye | — | 0.70 |

It is apparent from the results contained in Table 3 that Comparative dye a increased fog, while the Dyes 1 and 2 according to the invention decreased fog.

EXAMPLE 3

A predetermined amount of the dye as shown in Table 4 was added to a silver chlorobromide photographic emulsion (Cl: 10 mol %; Br: 90 mol %) containing α-pivaloyl-α-[4-(4-benzyloxyphenylsulfonyl)-phenoxy]-2-chloro-5-[γ-(2,4-di-t-amylphenoxy)-butylamide]-acetanilide (50 g per kg of emulsion) as a coupler for a yellow image and a blue sensitive emulsion was coated onto a photographic paper having thereon a polyethylene coating. The resulting photographic material was subjected to an optical wedge exposure for 0.1 second and then to color development in the next step. On the other hand, black-and-white development was carried out for reference.

| Development Processings | Temperature °C | Time (min) |
|---|---|---|
| Color Development | 38 | 4 |
| Stopping | 38 | 1 |
| Water Washing | 38 | 1 |
| Bleaching | 38 | 1.5 |
| Water Washing | 38 | 1 |
| Hardening | 38 | 1.5 |
| Water Washing | 38 | 3 |
| Stabilizing Bath | 38 | 1 |
| Drying | 38 | 1 |

The treating solutions used had the following compositions.

| | |
|---|---|
| **Color Development Solution** | |
| As described in Example 2 | |
| **Stopping Solution** | |
| As described in Example 2 | |
| **Bleaching Solution** | |
| Potassium Ferricyanide | 20 g |
| Potassium Bromide | 5 g |
| Borax (decahydrate) | 10 g |
| Water to | 1000 ml |
| **Hardener** | |
| Sodium Thiosulfate | 60 g |
| Sodium Sulfite | 5 g |
| Sodium Carbonate (monohydrate) | 30 g |
| Sodium Bicarbonate | 10 g |
| Water to | 1000 ml |
| **Stabilizer** | |
| Sodium Citrate (dihydrate) | 5 g |
| Boric Acid | 5 g |
| Sodium Metaborate | 3 g |
| Potassium Alum | 15 g |
| Water to | 1000 ml |

Table 4

| Dye | Amount Added to Emulsion (milligram mol/silver mol) | Fog in Color Development at 38°C for 4 min | Fog in Black-and-white Development at 38°C for 4 min |
|---|---|---|---|
| Dye 3 | 0.092 | 0.35 | 0.10 |
| Comparative Dye h | 0.092 | 0.50 | 0.10 |
| Comparative Dye f | 0.092 | 0.45 | 0.10 |
| No Dye | -- | 0.42 | 0.10 |

It is apparent from the results contained in Table 4 that Comparative Dyes f and h increased fog in the treatment at 38°C, while Dye 3 of the invention decreased fog.

The black-and-white developer used had the following composition:

| | | |
|---|---|---|
| Metol | 3.1 | g |
| Sodium Sulfite (anhydrous) | 45 | g |
| Hydroquinone | 12 | g |
| Sodium Carbonate (anhydrous) | 79 | g |
| Potassium Bromide | 1.9 | g |
| Water to | 1000 | ml |

EXAMPLE 4

A predetermined amount of the dye as shown in Table 5 was added to a silver chloride photographic emulsion (having a similar composition to Example 3) containing α-o-methoxybenzoyl-α-chloro4-[α-(2,4-di-t-amylphenoxy)-n-butylamido]acetanilide (50 g per 1 kg of emulsion) as a coupler for a yellow image and a blue sensitive emulsion was coated onto a photographic paper having thereon a polyethylene film coating subjected to a corona discharge treatment. The period of time of from the corona discharge treatment to the coating was within 30 minutes. The resulting photographic material was subjected to an optical wedge exposure for 0.1 second using a tungsten lamp (color temperature of light source: 2854°K) and then to color development in a manner similar to Example 3.

Table 5

| Dye or Comparative Additive | Amount of Compound Added (milligram/silver mol) | Color Development at 38°C for 8 Minutes Blue Sensitivity* | Fog |
|---|---|---|---|
| Dye 1 | 52 | 141 | 0.42 |
| Dye 7 | 59 | 129 | 0.41 |
| 1 Phenyl-3-pyrazolidone | 174 | 100 | 0.54 |
| No Additive | -- | 100 | 0.57 |

*Exposure was carried out through Fuji Filter-SP-1 as a blue filter. Standard sensitivity of dye free emulsion was set at 100

It is apparent from Table 5 that Dyes 1 and 7 of the invention increase the sensitivity and have the effect of decreasing the fog of the emulsion in the case of a support subjected to a corona discharge treatment to a greater extent than 1-phenyl-3-pyrazolidone.

EXAMPLE 5

80 g of 1-(2,4,6-trichlorophenyl)-3-[3-(2,4 -di-t-amylphenoxymethylamide)benzamide]-5-pyrazolone as a magenta coupler was completely dissolved in a mixture of 100 ml of tricresyl phosphate and 50 ml of ethyl acetate. Then 2 g of sorbitan monolaurate was dissolved therein. To this solution was added 2.5 g of dodecylbenzenesulfonic acid dissolved in 1 kg of a 10 weight % aqueous solution of gelatin, stirred at a high speed and further subjected to stirring using ultrasonic waves to obtain an emulsion.

A silver iodobromide emulsion having an iodide content of 6 mol % was prepared using the conventional double jet method and was used. This emulsion was chemically sensitized by the use of potassium chloroaurate (2 mg per mol of silver halide) and sodium thiosulfate (4 mg per mol of silver halide) in a conventional manner. This emulsion contained 103 g of gelatin per 1 mol of silver. The quantity of silver was 0.52 mol per 1 kg and the average grain size thereof was 0.78 micron. 100 g of water was added to 250 g of this emulsion, the emulsion was warmed to melt it and was held at 40°C. To the emulsion were added predetermined amounts of Dye 6 and anhydro-9-ethyl-5,5'-diphenyl-3-sulfopropyl3'-ethyloxacarbocyanine hydroxide as a Comparative Dye as shown in Table 6. The emulsion was stirred and allowed to stand for 15 minutes. 100 g of the above described melted emulsion was added thereto, 0.02 g of 4-hydroxy-6-methyl-1,3,3a,7-tetrazaindene was further added in the form of an aqueous solution and stirred. Moreover, 0.1 g of 1-hydroxy-3,5-dichlorotriazine sodium was added. The thus obtained emulsion was coated onto a polyethylene terephthalate base to give a film thickness of 5 microns on a dry basis, thus obtaining a specimen of light-sensitive material.

This specimen was cut into strips, subjected to an optical wedge exposure for 1/500 second to an actinometer having a light source with a color temperature of 5400°K through a Yellow FilterSC-50 (produced by the Fuji Photo Film Co. Ltd.) (permitting the transmission of light with wavelengths longer than 500 nm) and then subjected to the following development treatments:

| Treatments | | |
|---|---|---|
| Color Development | 38°C | 3 min |
| Stopping | " | 1 min |
| Hardening Bath | " | 1 min |
| Water Washing | " | 1 min |
| Bleaching Bath | " | 2 min |
| Water Washing | " | 1 min |
| Fixing Bath | " | 2 min |
| Water Washing | " | 2 min |
| Drying | | |

The resulting strips were subjected to measurement of the green filter density using an S-type densitometer manufactured by the Fuji Photo Film Co., Ltd., thus obtaining the relative sensitivity and magenta color formed fog. The results obtained are shown in Table 6.

Table 6

| Dye Used | Quantity Used (millimol gram) | Relative Sensitivity | Magenta Fog | HICI Effect |
|---|---|---|---|---|
| Dye 6 | $4 \times 10^{-2}$ | 100 | 0.25 | + |
| | $8 \times 10^{-2}$ | 100 | 0.18 | |

Table 6 -continued

| Dye Used | Quantity Used (millimol gram) | Relative Sensitivity | Magenta Fog | HICl Effect |
|---|---|---|---|---|
| Anhydro-9-ethyl-5,5'-diphenyl-3-sulfopropyl-3'-ethyloxa-carbocyanine Hydroxide | $1 \times 10^{-2}$ | 79 | 0.35 | – |
| | $2 \times 10^{-2}$ | 100 | 0.45 | |
| No Dye | | — | 0.32 | |
| Composition of Color Development Solution | | | | |
| Benzyl Alcohol | | — | 5 | ml |
| Sodium Hydroxide | | — | 0.5 | g |
| Diethylene Glycol | | — | 3 | ml |
| Sodium Hexametaphosphate | | — | 2 | g |
| Sodium Sulfite | | — | 2 | g |
| Potassium Bromide | | — | 2 | g |
| 4-Amino-3-methyl-N-ethyl-β-hydroxyethylaniline sesquisulfate (monohydrate) | | — | 5 | g |
| Metaboric Acid | | — | 0.5 | g |
| Sodium Metaborate | | — | 77 | g |
| Water to | | | 1000 | ml |
| Stopping Solution | | | | |
| Sodium Acetate | | — | 30 | g |
| Glacial Acetic Acid | | — | 8 | ml |
| Water to | | | 1000 | ml |
| Hardening Bath | | | | |
| Sodium Hexametaphosphate | | — | 1 | g |
| Borax ((heptahydrate) | | — | 20 | g |
| Formalin (37%) | | — | 10 | ml |
| Water to | | | 1000 | ml |
| Bleaching Solution | | | | |
| Ferric Sodium Ethylenediamine-tetraacetate (dihydrate) | | | 30 | g |
| Potassium Bromide | | | 50 | g |
| Disodium Ethylenediamine-tetraacetate | | | 5 | g |
| Boric Acid | | | 3 | g |
| Borax | | | 1.5 | g |
| Water to | | | 1000 | ml |
| Fixer | | | | |
| Sodium Thiosulfate | | | 150 | g |
| Sodium Sulfite | | | 15 | g |
| Borax | | | 12 | g |
| Glacial Acetic Acid | | | 15 | ml |
| Potassium Alum | | | 20 | g |
| Water to | | | 1000 | ml |

The silver halide emulsion was coated onto a support member, preferably, having a hydrophobic surface, for example, transparent or opaque plastic films such as cellulose acetate films and polyethylene terephthalate films, papers laminated with plastic films such as polyolefins and synthetic papers. The light-sensitive material according to the invention can have any of a dyed layer for antihalation as disclosed in U.S. Pat. No. 3,652,283, and a filter layer as disclosed in U.S. Pat. No. 3,653,905, a dyed layer for improving the safe light stability as disclosed in U.S. Pat. 3,575,704 and an intermediate layer for preventing the color mixing as disclosed in Japanese Patent Publication No. 18459/66.

The light-sensitive material of the invention is applicable to color negative films, color print papers, color sensitive materials of the diffusion transfer type, color intermediate films and color photographic materials for drawing as industrial materials. Moreover, the light-sensitive material of the invention can be used for color paper sensitive materials suitable for high temperature and rapid development processings.

While the invention has been described in detail and with reference to specific embodiments thereof, it will be apparent to one skilled in the art that various changes and modifications can be made therein without departing from the spirit and scope thereof.

What is claimed is:

1. A method for producing an image having a reduced amount of fog which comprises a step of color developing at a temperature of at least 30°C., an exposed light-sensitive silver halide material containing at least one spectrally sensitized silver halide photographic emulsion layer on a support, said emulsion layer containing at least one sensitizing dye having the halide ion concentration increasing effect which can be determined by:

a. warming mixture A to 70°C., wherein mixture A comprises:

| | |
|---|---|
| Distilled water | 500 ml |
| Ammonium Bromide | 20 g |
| Sodium chloride | 10 g |
| Citric acid | 50 g |
| Gelatin | 70 g |

b. adding mixture B to mixture A with agitation over 50 minutes, wherein mixture B comprises:

| | |
|---|---|
| Distilled water | 500 ml |
| Silver Nitrate | 50 g |
| Citric acid | 50 g |

c. physically aging, cooling, setting and washing with water the product from Step (b) to yield an emulsion with a pH of 6.4 and a pAg of 7.8;

d. charging a first and a second emulsion vessel each with 100 g. of the product from Step (c), melting at 40°C., stirring and storing the two emulsions;

e. adding a sensitizing dye to the first emulsion vessel as a methanol solution in a concentration of $1 \times 10^{-3}$ or $5 \times 10^{-4}$ mol, stirring and allowing said first emulsion to stand for about 10 minutes;

f. adding the quantity of methanol used in Step (e) to the said second emulsion;

g. measuring any potential difference (ΔEAg) between said two emulsions;

h. determining the increase or decrease in the pAg of the said first emulsion from the measurement of the ΔEAg; and i. choosing those dyes which cause an increase in the pAg of the first emulsion.

2. The method as claimed in claim 1, wherein said sensitizing dye is a dye having the halide ion concentration increasing effect and is selected from compounds represented by the following Formula (I):

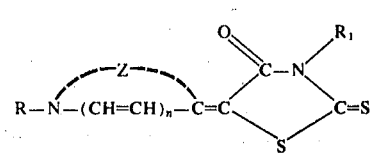

(I)

in which R represents a sulfoalkyl group, Z represents an atomic group necessary for forming a benzoxazole nucleus, a benzimidazole nucleus, a benzothiazole nucleus or a pyridine nucleus, *n* represents 0 or 1, $R_1$ represents a lower alkyl group, a carboxyalkyl group, an aralkyl group, or a saturated or unsaturated cyclic hydrocarbon group; or a sensitizing dye represented by the following Formula (II):

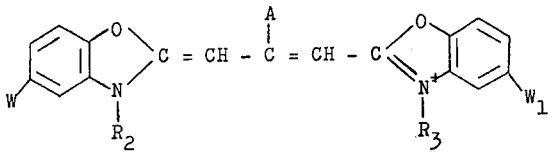

(II)

in which A represents a lower alkyl group, $R_2$ and $R_3$ each represents an alkyl group, a sulfoalkyl group or a sulfoalkoxylalkyl group, at least one of $R_2$ or $R_3$ being a sulfoalkyl group or a sulfoalkoxyalkyl group, W represents a halogen atom or a phenyl group and $W_1$ represents a halogen atom.

3. The method of claim 2, wherein said sulfoalkyl group is a sulfoethyl group, a sulfopropyl group or a sulfobutyl group, wherein said aralkyl group is a benzyl group, wherein said hydrocarbon group is a hexyl group or an aryl group, wherein said lower alkyl group is a methyl group or an ethyl group and wherein said alkyl group is a methyl group, an ethyl group or a propyl group.

4. The method of claim 1, wherein said support is a resincoated paper or a synthetic paper.

5. The method of claim 1, wherein said emulsion contains a two equivalent diketomethylene type coupler as a yellow coupler or a two equivalent pyrazolone type coupler as a magenta coupler.

6. The method of claim 1, wherein said sensitizing dye is one of the following:

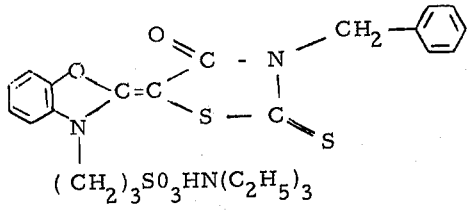

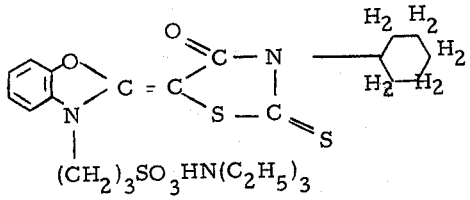

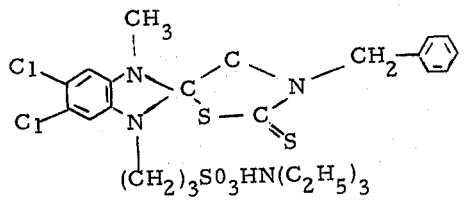

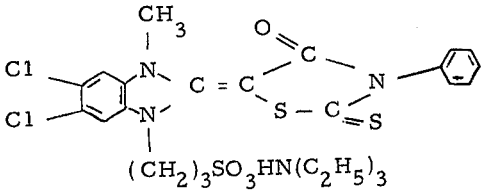

or an oxacarbocyanine dye represented by the Formula (II):

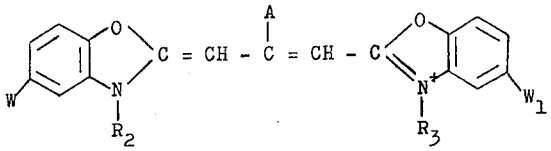

(II)

in which A represents a lower alkyl group, $R_2$ and $R_3$ each represents an alkyl group, a sulfoalkyl group or a sulfoalkoxyalkyl group, at least one of $R_2$ or $R_3$ being a sulfoalkyl group or a sulfoalkoxyalkyl group, W represents a halogen atom or a phenyl group and $W_1$ represents a halogen atom, and said support is resin coated paper, synthetic paper, polyethylene terephthalate film or cellulose acetate film.

7. The method of claim 1, wherein said light-sensitive silver halide material contains at least a coupler-in-the-emulsion.

8. The method as claimed in claim 2, wherein said support is a resin coated paper, synthetic paper, polyethylene terephthalate film or cellulose acetate film.

9. A method for suppressing fog in high temperature color development of an exposed light-sensitive silver halide material containing at least one spectrally sensitized silver halide photographic emulsion layer on a support, wherein said emulsion layer contains at least one sensitizing dye chosen by a consideration of the halide concentration increasing effect of the dye which can be determined by:

a. warming mixture A to 70°C., wherein mixture A comprises:

| | |
|---|---|
| Distilled water | 500 ml |
| Ammonium bromide | 20 g |
| Sodium chloride | 10 g |
| Citric acid | 50 g |
| Gelatin | 70 g |

b. adding mixture B to mixture A with agitation over 50 minutes, wherein mixture B comprises:

| | |
|---|---|
| Distilled water | 500 ml |
| Silver nitrate | 50 g |
| Citric acid | 50 g |

c. physically aging, cooling, setting and washing with water the product from Step (b) to yield an emulsion with a pH of 6.4 and a pAg of 7.8;

d. charging a first and a second emulsion vessel each with 100 g. of the product from Step (c), melting at 40°C., stirring and storing the two emulsions;

e. adding a sensitizing dye to the first emulsion vessel as a methanol solution in a concentration of $1 \times 10^{-3}$ or $5 \times 10^{-4}$ mol, stirring and allowing said first emulsion to stand for about 10 minutes;

f. adding the quantity of methanol used in Step (e) to the said second emulsion;

g. measuring any potential difference ($\Delta EAg$) between said two emulsions;

h. determining the increase or decrease in the pAg of the said first emulsion from the measurement of the $\Delta EAg$; and i. choosing those dyes which cause an increase in the pAg of the first emulsion.

10. The method of claim 9, wherein said support is a resincoated paper or a synthetic paper.

* * * * *